United States Patent [19]

Barth

[11] Patent Number: 4,618,839

[45] Date of Patent: Oct. 21, 1986

[54] MICROWAVE ATTENUATOR

[76] Inventor: Jon E. Barth, 1300 Wyoming St., Boulder City, Nev. 89005

[21] Appl. No.: 722,210

[22] Filed: Apr. 11, 1985

[51] Int. Cl.[4] ..... H01P 1/22

[52] U.S. Cl. ..... 333/81 A; 338/300; 338/308

[58] Field of Search ..... 333/81 R, 81 A; 338/230, 260, 300, 306-309

[56] References Cited

U.S. PATENT DOCUMENTS 2,620,396 12/1952 Johnson et al. ..... 333/81 A 2,968,774 1/1961 Rodriguez ..... 333/81 A 3,311,856 3/1967 Conney ..... 333/81 R

*Primary Examiner*—Paul Gensler

*Attorney, Agent, or Firm*—Edward J. Quirk

[57] ABSTRACT

A microwave attenuator forming two series connected L-pads is comprised of a plurality of electrically conductive, resistive, and non-conductive sections disposed on the surface of an elongate dielectric cylindrical base. The series resistances are connected through a conducting strip having an impedance that matches the impedance of the L-pads.

17 Claims, 9 Drawing Figures

MICROWAVE ATTENUATOR

BACKGROUND OF THE INVENTION

This invention relates to resistive microwave attenuators that are used for high peak and average power dissipation. More particularly, the invention in a preferred form relates to an attenuator element having an elongate cylindrical base with a plurality of electrically conductive, resistive, and non-conductive sections disposed on its surface to effectively form two L-pads having shunt resistances with a common ground, and where the series resistances are connected through a conducting strip having a predetermined impedance.

VHF T-pad attenuators are well known and consist basically of a pair of coupled series resistors and a grounded shunt resistor. Early designs recognize the importance of designing a high frequency attenuator to avoid any mismatch in impedance between a transmission line and the attenuator, resulting in a "reflection" back into the transmission line of a portion of the energy reaching the attenuator. Early designs, such as are described in Johnson et al., U.S. Pat. No. 2,620,396, used rod resistors fabricated from an insulating cylindrical substrate with a resistive film deposited on the surface. Highly conductive metal contacts were placed at both ends of the resistive film to provide connection to the resistor. These cylindrical resistors were easy to connect to the cylindrical coaxial center conductor of the terminals at both ends of the unit. The shunt resistor connected to ground between the two series resistors was originally formed on a round ceramic or glass disc substrate with a resistance film deposited on the surface of the disc. Highly conductive annular metal connectors at the outside circumference of the disc, and around a hole in the center of the disc, provided ohmic connections to the shunt resistor. The disc resistor was in the center of the attenuator, and its outer connection made ohmic contact to the inside diameter of the tubular body. The input and output resistors and shunt resistor were interconnected mechanically and electrically at the center hole of the shunt disc resistor.

Tapered outer conductors around the series rod resistors provided a better high frequency response and input impedance match. This taper around the cylindrical resistor is the most effective when it is an exponential, or logarithmic, taper so that the resistive parts of an attenuator are pure resistive elements at all frequencies. Exponential tapers around cylindrical film resistors are well known, and are described in U.S. Pat. Nos. 2,273,547, 2,399,645, and 2,438,915.

Maintenance of a constant resistance of the shunt disc resistor at all frequencies by providing an electrically correct ground plane has been difficult to accomplish. Design of the shunt resistor is important so that the attenuator will have a constant attenuation at all frequencies. Complex shapes for this element have been tried, but have not seemed to enjoy commercial success principally because of the difficulty of manufacture. An example of such an element is disclosed in U.S. Pat. No. 2,968,774. Various other arrangements of shunt resistors include a four-spoke arrangement as shown in U.S. Pat. Nos. 2,434,560 and 2,994,049, and a two-spoke design as shown in U.S. Pat. Nos. 3,739,305 and 3,996,534. These shunt resistors work effectively without an exponential housing only because the resistive element lengths are very short relative to a wavelength.

An advance in the state of the art of attenuator technology involved the use of microstrip construction with the resistors being placed on thin flat ceramic substrates. Examples of such construction are shown in U.S. Pat. Nos. 3,157,846, and 3,227,975 and 4,309,677. These assemblies were facilitated by developments in hybrid semiconductor manufacturing methods which used ceramic substrates. However, for good high frequency performance, flat resistors laid out on a ceramic surface are difficult to house to provide proper impedance. This is because of the uniform spacing to the ground plane on the opposite side of the ceramic substrate which results in an inability to vary the impedance around the resistors along their length. To a certain extent, this problem has been solved by reducing the physical size of the resistive assembly to the point where the lack of the proper tapered housing for the resistances provides relatively minimal reactances at high frequencies. However, as the size of the resistive elements is reduced, the power handling capability of the unit is also reduced because of operating temperature limitations of the resistance film. In an effort to overcome this problem, high thermal conductivity ceramic substrates have been used to transfer and dissipate heat generated to an adjacent metal body.

At the present time, the T-pad design described in Barth, U.S. Pat. No. 3,665,347, has the best high frequency response relative to the size of the elements of any commercial unit. This device uses three cylindrical film resistors with exponential tapered housings around each resistor to provide pure resistance values at all frequencies. The shunt resistor in this design in mounted physically in a member perpendicular to the series resistors, thus requiring the exponential housing around the shunt resistor to also be maintained perpendicular to the axis of the body of the housing. Accordingly, while the unit is technically excellent, its manufacture is complicated and more costly than other designs. Furthermore, the creation of a secure mechanical and electrical connection of the series resistors with the shunt resistor can be problematic.

The invention provides an improvement on the design set forth in my earlier U.S. Pat. No. 3,665,347 in that it is much simpler to manufacture, but retains substantially the excellent performance characteristics of that unit. In a broad sense, rather than being a conventional T-pad attenuator, the attenuator of the invention comprises a pair of L-pads having shunt resistances with a common ground where the series resistances are connected through a conductive connecting strip having an impedance that matches the impedance of the adjacent L-pads. The impedance of the strip is selectively calculated for each attenuator size, and is determined by its physical characteristics such as material of construction, thickness, and width. In a specific embodiment, the invention comprises the afore described electrical configuration laid out on the peripheral external surface of a cylindrical dielectric base member. The various other resistive, conductive elements, and non-conductive sections are laid out in a predesigned orientation around the surface of the cylindrical base, with the series resistors generally consisting of film sleeves located at opposite ends of the cylinder. The two commonly grounded shunt resistors and the interconnecting conductive strips are generally located in a central portion of the cylindrical element. These elements are easily mounted in a conventional, exponentially tapered conductive metal housing similar to the one shown in U.S. Pat. No. 3,665,347, except that the perpendicular lug portion shown in that patent is no longer necessary because of the improved design of the elongated resistive element.

Accordingly, it is an object of the invention to provide a new attenuator design that is relatively easy to manufacture, but is able to handle high power with exceptional fidelity. It is yet another object of the invention to provide a coaxial attenuating element mounted inside of a tubular housing which acts as a ground for the shunt resistor, thus permitting encapsulation while maintaining good high frequency characteristics. It is yet another object of the invention to provide increased power handling capability of the resistive elements of a T-pad by providing a novel shunt resistor mounted on the same cylindrical substrate as the series resistors. By producing long resistors with a shape having a uniform current density, and mounting them in a housing that allows a constant resistance at all frequencies, high energies can be dissipated without damage to the resistive elements. These and other objects of the invention will be apparent from the following detailed description of a preferred embodiment thereof.

SUMMARY OF THE INVENTION

A cylindrical microwave attenuator comprises two L-pads having series resistances connected through a conducting strip mounted on the cylindrical surface, where the conducting strip has an impedance of the connecting strip that matches the impedance of the adjacent L-pads. More particularly, the attenuator has a cylindrical base having a pair of spaced resistive sleeves adjacent the ends of the cylinder, a pair of spaced annular conductive bands adjacent the respective interior edges of the sleeve, an elongated conductive strip connecting said annular bands, first and second resistive strips each having an edge adjacent to one connective band, and a common ground conductive strip electrically connecting the resistive strips. The ground conductive strip is electrically connected to the connector strip only through each of the pair of resistant strips.

BRIEF DESCRIPTION OF THE DRAWINGS

The invention is best understood with reference to the drawings, in which.

DETAILED DESCRIPTION OF A PREFERRED EMBODIMENT

Figure 1:
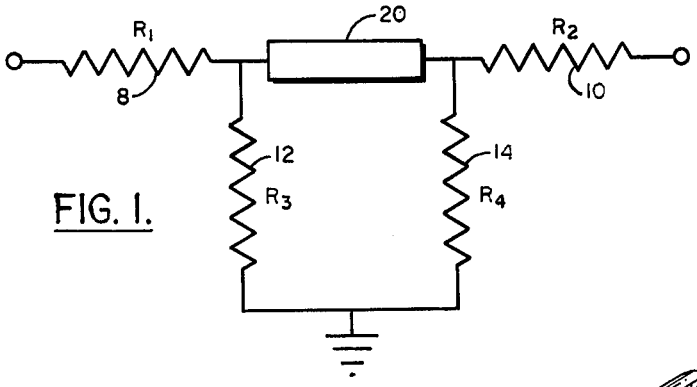
FIG. 1 is a schematic portrayal of the circuitry of the attenuator of the invention.
Figure 7:
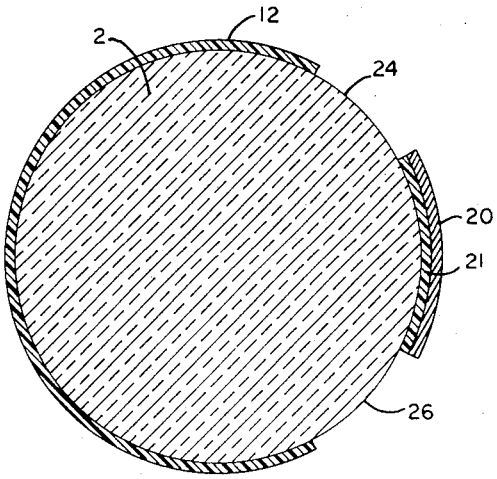
Figure 8:
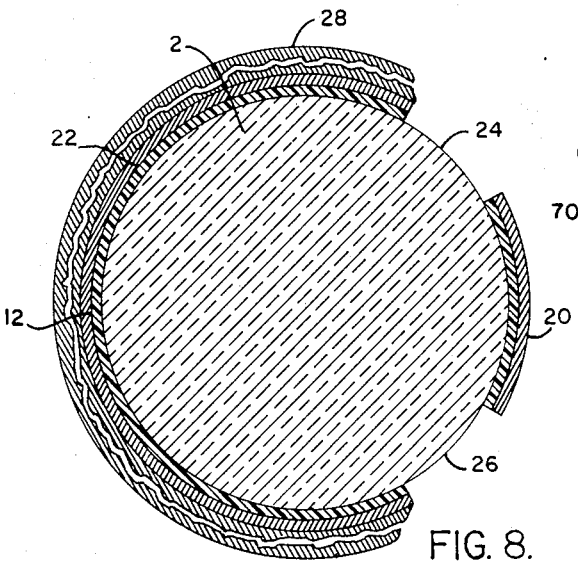

FIG. 1 shows a simple schematic diagram of the attenuator of the invention. Simple T-pad attenuators are formed from a pair of series resistors generally referred to schematically as $R_1$ and $R_2$, with a grounded shunt resistor referred to as $R_3$ connected between $R_1$ and $R_2$. The schematic of the invention is shown in FIG. 1. The attenuator is formed from a pair of back to back L-pads consisting of $R_1/R_3$ and $R_2/R_4$ with an interconnecting conducting strip 20 (painted over resistive strip 21 see FIG. 7) forming the low impedance junctions of the L-pads. This configuration is analogous to a conventional T-pad, where $R_1$ and $R_2$ are the series resistors, and $R_3$ and $R_4$ are each equal to twice the resistive value of the grounded shunt resistor of the T-pad. Ideally, the impedance of the connector 20 matches the lower impedance of each of the two L-pads. The attenuator of the invention is a passive device and is completely bilateral, i.e., operation is exactly the same if the input and output are reversed. Analysis of the attentuator as two L-pads with a low impedance interconnection explains its wide bandwidth operation at microwave frequencies.

Figure 3:
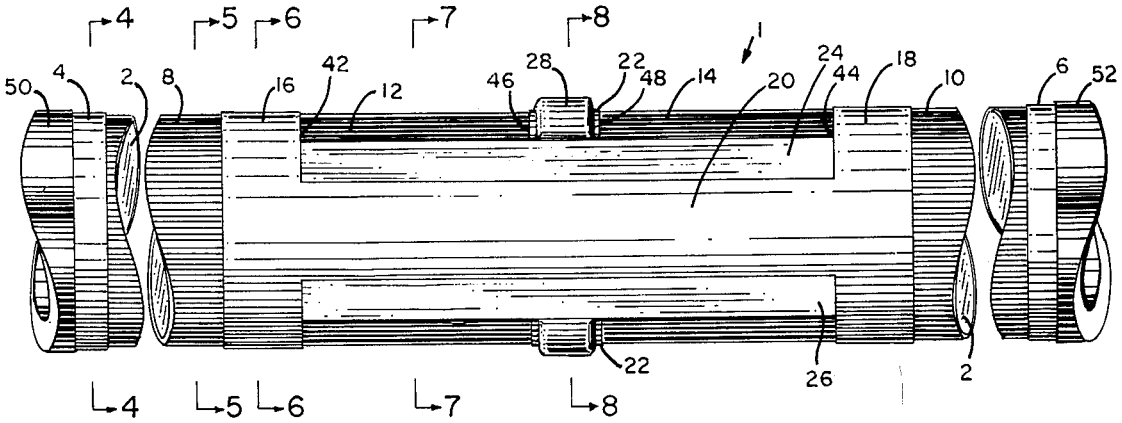
FIG. 3 is a perspective view of a cylindrical attenuator elements of the invention.
Figure 4:
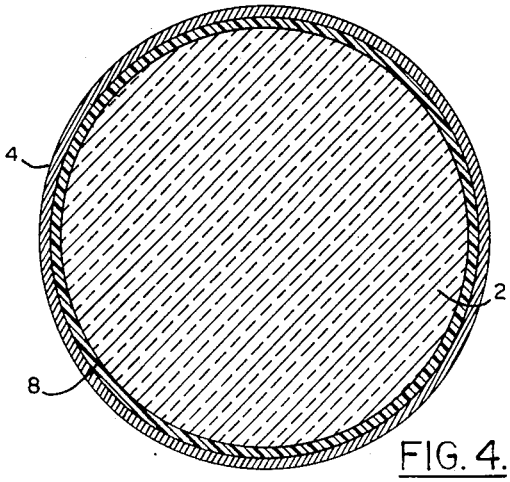
FIGS. 4–8 are section views along the attenuator, the sections being wafer-thin for ease of understanding and being taken along the section lines shown in FIG. 3.
Figure 5:
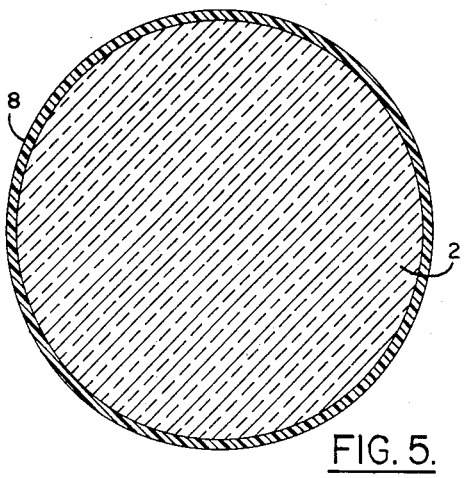
Figure 6:
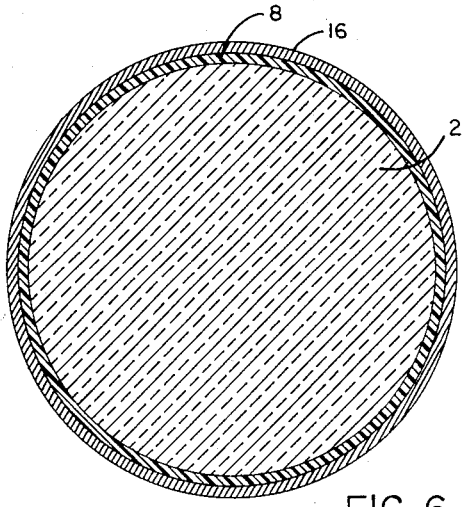

The layout of the resistive and conductive components on the surface of a dielectric cylindrical base is best shown in FIG. 3. Attenuator 1 comprises a dielectric cylindrical base member 2 having a plurality of resistive and conductive sections mounted on its external surface. A pair of identical conductive bands 4 and 6 encircle the base at its ends. A pair of brass electrode sleeves 50 and 52 are mounted on the ends of the attenuator for connection to its external circuitry. Immediately adjacent the end bands 4 and 6 are resistive strips 8 and 10 which take the appearance of cylindrical sleeves which are spaced from each other at opposite end portions of the cylindrical base. The resistive strips or sleeves 8 and 10 correspond to $R_1$ and $R_2$, respectively, in FIG. 1, and are the series resistors of the attenuator. Conductive bands 16 and 18, which encircle the periphery of the cylinder, are mounted adjacent the interior edge of resistive sleeves 8 and 10. The term "strip" as used herein is used to refer to a resistive conductive or non-conductive section of the cylindrical surface and is not intended to convey any dimensional implications or limitations.

In the interior portion of the cylinder, between the series resistive strips 8 and 10, are located the shunt resistors and the necessary interconnections between the series and shunt resistors. An elongate conductive connecting strip 20, substantially rectangular in shape, is axially oriented on the periphery of the cylinder and connects annular conducting bands 16 and 18. Conducting strip 20 and bands 16 and 18 form an "H"-shaped conducting path, with the legs of the "H" completely encircling the base. Resistive strips 12 and 14, which correspond to $R_3$ and $R_4$ on FIG. 1, are sections of cylindrical strips which do not extend around the entire periphery of the surface. At low frequencies, $R_3$ and $R_4$ are simply two identical resistors in parallel that form the usual shunt resistance of a T-pad. Semi-cylindrical strip 12 has an edge 42 adjacent conducting band 16, and similar section 14 has an edge 44 adjacent conductive band 18.

Figure 2:
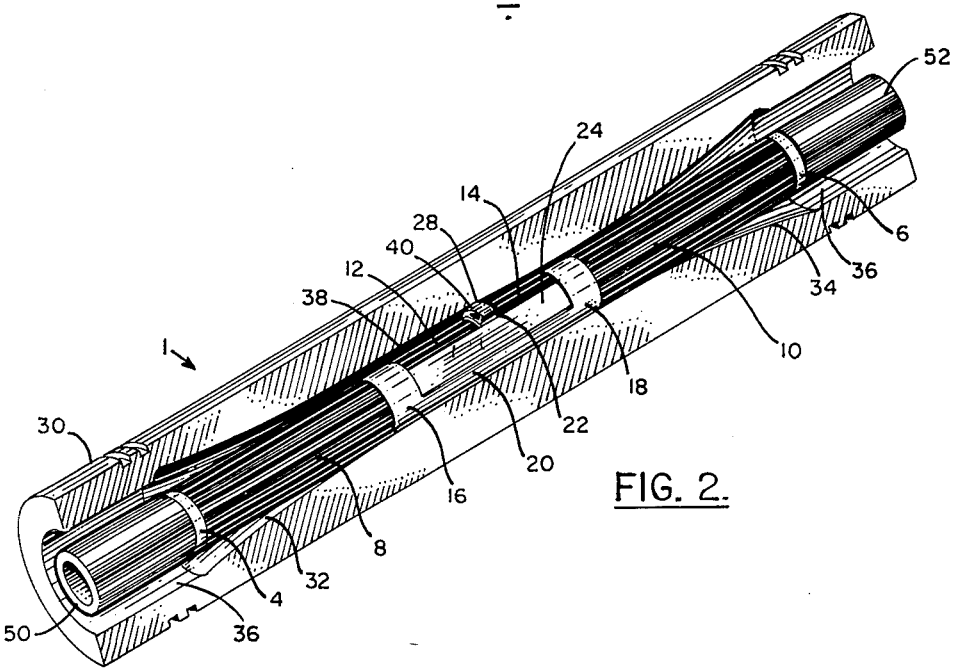
FIG. 2 is a perspective view thereof mounted in a metal housing, with a portion of the housing cut away.

An annular ground-conductive strip 22, which is parallel and intermediate to bands 16 and 18, separates resistive strips 12 and 14, which are equal to each other in resistance. Strip 22 is an annular band segment which has two circumferential elongate sides, and which has two short ends which are bounded by non-conductive zones 24 and 26. The segment may extend from about 45° to about 210° around the cylindrical circumference, depending on the attentuator characteristics. Resistive strips 12 and 14 are substantially rectangular (if laid out on a planar surface), with two opposing (short) edges adjoining non-conductive surfaces, and the other two opposing (long) edges electrically connected by conductive strips to a series resistor and to ground. As shown in FIG. 2, conductive strip 22 is attached to ground by means of a projecting metal (e.g., tin) flange or projection 28 which contacts an interior wall of the housing 30 when the attenuator is mounted therein. Non-conducting strips 24 and 26 are coextensive with and adjacent to conductive strip 20, and insulate the ground-conductive strip from $R_1$ and $R_2$. The non-conductive strips are actually bare i.e., non-painted, portions of the surface.

FIGS. 4–8 are thin "slices" of the cylindrical attenuator which show the instant cross-sectional appearance at the location along the cylindrical body corresponding to the section lines shown in FIG. 3, with the section numbers corresponding to the Figure numbers. The drawings in these Figures are not precisely to scale, and are simply intended to show the various layers of dielectric, resistive, and conductive surfaces at each point along the cylindrical periphery.

Figure 9:
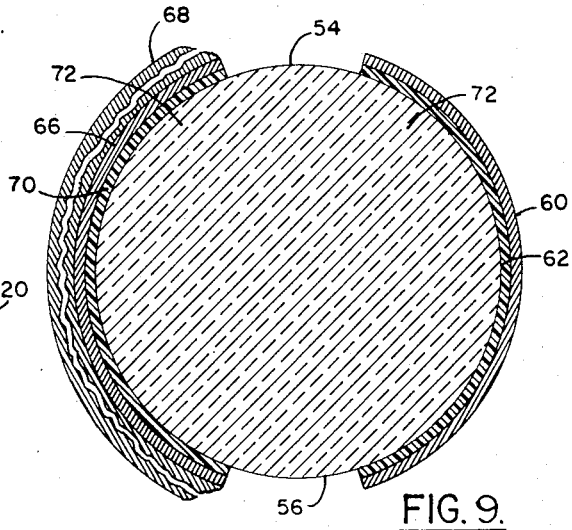
FIG. 9 is a section view of an alternate embodiment of the invention, with the section being taken along the portion of the attenuator analogous to section lines 8—8 shown in FIG. 3.

FIG. 9 is an alternate embodiment of the attenuator, as illustrated by a section taken at the location of section 8—8 of FIG. 3. The design is similar to that shown in FIG. 3, except that connecting band 60, mounted over the layer of resistive material 62 which is deposited on dielectric substrate 72, is substantially wider than in the band 20 shown in FIG. 3. The ground-conductive strip 66 and tin ground contact 68 (mounted over resistive film 70) are concomitantly narrower (i.e., occupy a smaller radial arc around the cylindrical periphery). Non-conductive strips 54 and 56 (corresponding to 24 and 26 in FIG. 8) are on opposing sides of the cylinder in this design. The design of FIG. 9 is approximately a 20 db attenuator. As $R_1$ and $R_2$ increase in length, and as the shunt resistors become circumferentially shorter, attenuation increases.

Metal housing 30 is similar to the housing disclosed in U.S. Pat. No. 3,665,347, although because of the simplified configuration of the attenuator, a projecting lug on the housing is not necessary. The housing consists of conductive metal, such as brass, and has a hollow cavity 32 having an internal wall which varies in diameter along its length. The interior chamber has end portions 36 of constant diameter and a central portion 38 also of constant diameter. Connecting chamber portions 32 and 34 are horn shaped, with the cavity wall increasing outwardly according to an exponential curve. To properly mount the attenuator in the housing, a plastic spacing ring (not shown), which extends around the portion of the periphery not covered by tin flange 28, may be used. The purpose is simply to have a uniform flange extending outwardly around the entire cylindrical periphery to enable the attenuator to be firmly mounted in the housing.

The construction of the attenuator cylinder is conventional. The dielectric base is made from a glass or ceramic material, and is non-conductive. The resistive film may be metal (e.g. nichrome), carbon, or any similar resistive material, and the conductive material is a metal such as silver, copper, or nickel which is painted or plated on to the surface. While the layout of the conductive and resistive materials on the cylindrical periphery has been described in terms of strips, in actuality the attenuator is fabricated by coating the entire cylindrical surface with resistance material, painting the silver conductive strips over the resistant material, and removing the resistance material in the voids spots 24 and 26 by masking the adjacent area and abrading the resistive surface away with a fine stream of air-carried abrasive. Accordingly, all of the resistive areas on the cylindrical surface are coextensive; however, because of the extreme difference in conductivity of the conductive strips and resistive areas, as a practical matter the resistive strip is shorted out when connected in parallel with a conductive strip. The ground contact 28 is generally fabricated from a relatively soft conductive metal, such as tin, which is sufficiently pliable to conform to the housing surface and ensure adequate electrical contact, yet is sufficiently strong to hold the assembly in place during construction. It also provides a very low resistance and short path to ground, which is also important for dissipation of thermal energy. Typically, the dielectric rod may have a diameter of 3/16", the resistive film (if nichrome) may be 0.00001" thick, and the conductive silver paint is 0.0005–0.0001" thick.

Although the attenuator of the invention has been described with respect to a specific embodiment thereof, various modifications to this embodiment within the scope and spirit of the invention will be readily apparent to those skilled in the art. Accordingly, the foregoing description should not be construed as limiting, and the invention should be limited only by the following claims as fairly construed.

I claim:

1. A microwave attenuator comprising a dielectric base having an elongate, generally cylindrical peripheral surface, a first resistive strip deposited on said surface adjacent an end portion of the attenuator, a second resistive strip deposited on said surface adjacent another end portion of the attenuator, first and second spaced annular conductive bands deposited on said surface adjacent said first and second resistive strips, respectively, said bands defining an interior annular portion of the cylindrical surface between said end portions, a first conductive strip connecting said conductive bands, a second conductive strip intermediate said conductive bands, a third resistive strip disposed between said first conductive band and said second conductive strip and in electrical connection therewith, and a fourth resistive strip disposed between said second conductive band and said second conductive strip and in electrical connection therewith.

2. The microwave attenuator of claim 1 wherein the first and second resistive strips are deposited on the surface in the form of a cylindrical sleeve.

3. The microwave attenuator of claim 1 wherein the first conductive strip is an elongate axial stripe having straight parallel edges.

4. The microwave attenuator of claim 1 wherein the first conductive strip is an elongate stripe having substantially parallel edges, said edges being bounded by a non-conductive zone.

5. The microwave attenuator of claim 1 wherein the second conductive strip is an annular band segment substantially equally spaced between said annular conductive bands.

6. The microwave attenuator of claim 1 wherein the band segment extends from about 45° to about 210° around the circumference of the surface.

7. The microwave attenuator of claim 1 wherein the first and second resistive strips comprise annular sleeves which extend around the periphery of the surface.

8. The microwave attenuator of claim 1 also comprising a third annular conductive band deposited adjacent an outer portion of the first resistive strip, and a fourth annular conductive band deposited adjacent an outer portion of the second resistive strip, said third and fourth bands serving as terminals for connecting microwave attenuator to external circuitry.

9. The attenuator of claim 1 also comprising a conductive flange in contact with said second conductive strip.

10. The attenuator of claim 1 also comprising a conductive housing enclosing said attenuator, and electrical conduit means for electrically interconnecting said housing and said second conductive strip.

11. The attenuator of claim 10 wherein the electrical conduit means comprises a conductive flange in contact with the second conductive strip.

12. The attenuator of claim 10 wherein the housing has an internal elongate chamber defined by walls, said chamber having a first constant diameter over a central portion of the chamber, a second constant diameter larger than said first diameter at opposing end portions of the chamber, and a gradually increasing diameter between said central and end portions of the chamber.

13. The attenuator of claim 12 wherein the gradually increasing diameter increases according to an exponential curve.

14. A cylindrical microwave attenuator comprising a dielectric cylindrical base member having resistive and conductive materials deposited on the cylindrical peripheral surface thereof in a predetermined pattern, said pattern including first components including sequentially, with adjacent boundaries, first terminal means for electrically interconnecting the attenuator to external circuitry, a first strip of resistive material, a conductive annular band, a second strip of resistive material, and a ground-conductive annular band segment, said first components electrically comprising a first L-pad, second components including sequentially, with adjacent boundaries, second terminal means for electrically interconnecting the attenuator to external circuitry, a third strip of resistive material, a second conductive annular band, a fourth strip of resistive material, and the ground-conductive annular band segment, said second components electrically comprising a second L-pad, and an elongate conductive strip having spaced interconnections with said first and second annular bands, said conductive strip having an impedance substantially equal to the impedance of the first and second L-pads.

15. The attenuator of claim 14 wherein the conductive strip is deposited axially along the surface of the attenuator.

16. The attenuator of claim 14 wherein the conductive strip is electrically insulated along its boundaries with the exception of the interconnections with the first and second annular bands.

17. A microwave attenuator comprising a dielectric base having an elongate, generally cylindrical peripheral surface, a first resistive strip deposited on said surface adjacent an end portion of the attenuator, a second resistive strip deposited on said surface adjacent another end portion of the attenuator, first and second spaced annular conductive bands deposited on said surface adjacent said first and second resistive strips, respectively, said bands defining an interior annular portion of the cylindrical surface between said end portions, a first conductive strip connecting said conductive bands, a second conductive strip intermediate said conductive bands, and shunt resistance means and a ground-conductive strip disposed within said interior annular portion, said first and second resistive strips being electrically connected through the shunt resistance means and the ground-conductive strip to ground.

* * * * *